US007381665B2

(12) United States Patent
Onikubo et al.

(10) Patent No.: US 7,381,665 B2
(45) **Date of Patent: *Jun. 3, 2008**

(54) PRESS FELT FOR PAPERMAKING AND MANUFACTURING METHOD

(75) Inventors: Akira Onikubo, Tokyo (JP); Hiroyuki Oda, Tokyo (JP); Yasuhiko Kobayashi, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 354 days.

This patent is subject to a terminal disclaimer.

(21) Appl. No.: 11/032,583

(22) Filed: Jan. 10, 2005

(65) Prior Publication Data

US 2006/0016572 A1 Jan. 26, 2006

(30) Foreign Application Priority Data

Jul. 26, 2004 (JP) ..... 2004-217489

(51) Int. Cl.

| | |
|---|---|
| ***B32B 5/06*** | (2006.01) |
| ***B32B 5/22*** | (2006.01) |
| ***D21F 7/08*** | (2006.01) |
| ***D21F 3/00*** | (2006.01) |

(52) U.S. Cl. ..... 442/312; 442/319; 162/358.2; 162/900

(58) Field of Classification Search ..... 442/312, 442/305, 319; 162/358.2, 900

See application file for complete search history.

(56) References Cited

U.S. PATENT DOCUMENTS

| | | | | |
|---|---|---|---|---|
| 7,105,077 | B2 * | 9/2006 | Onikubo et al. | 162/358.2 |
| 2004/0173274 | A1 * | 9/2004 | Onikubo et al. | 139/383 A |

FOREIGN PATENT DOCUMENTS

| | | | |
|---|---|---|---|
| FR | 2727442 | A1 * | 5/1996 |
| JP | 02229247 | A * | 9/1990 |

OTHER PUBLICATIONS

FR 272442 A1 Derwent Englsih Abstract, May 31, 1996.*
JP 2001-234456 English Abstrac, Aug. 31, 2001 plus 3 pages of Figures.*
JP 02-229247 A Ikenaga et al. (English Abstract).*

* cited by examiner

*Primary Examiner*—Jenna-Leigh Johnson
(74) *Attorney, Agent, or Firm*—Howson & Howson LLP

(57) ABSTRACT

A press felt for papermaking comprises a base body, a fibrous assembly, and a three-dimensional knitted fabric layer comprising two pieces of fabric connected by connecting fibers. The three-dimensional knitted fabric layer is disposed within the press felt at a distance from both the wet paper web contact surface and the machine contact surface of the felt. At least some of the connecting fibers are diagonal fibers.

19 Claims, 18 Drawing Sheets

PRESS FELT FOR PAPERMAKING AND MANUFACTURING METHOD

FIELD OF THE INVENTION

This invention relates to a press felt for papermaking, used in a papermaking machine (hereinafter, referred to as a "felt")

BACKGROUND OF THE INVENTION

As is generally known, a felt is used to remove water from a wet paper web in the press part of a papermaking machine.

In the press part PP of a papermaking machine shown in FIG. 14, water is removed from a wet paper web WW proceeding between a pair of press rolls PR, using a single felt 10A. In the apparatus shown in FIG. 15, water is removed from a wet paper web WW pinched between two felts 10A in the press part PP. In the apparatus shown in FIG. 16, in which the press part PP comprises a press roll PR and a press shoe PS with a resin belt SB therebetween, water is removed from a wet paper web WW pinched between two felts 10A.

In each of the cases illustrated in FIGS. 14-16, the felt 10A is driven by the rotating press roll or rolls PR, and is compressed in the press part PP.

The general structure of a felt 10A is illustrated in FIG. 17. The felt 10A is endless, and comprises a base body 20A, and a fibrous assembly 30A connected to the base body 20A. The base body, which may be a woven fabric, imparts strength to the felt. The felt 10A enters into the press part PP in contact with a wet paper web, and is compressed as pressure is applied in the press part PP. The felt recovers its pre-compression condition after it moves out of the press part.

Compressibility and recoverability are necessary in a felt because, if the felt were not compressed when entering the press part of the papermaking machine, the wet paper web would be torn as a result of the pressure applied by the press rolls. Moreover, the speed of the felt and the press pressure have both increased as a result of developments in papermaking machinery in recent years. Accordingly, the conditions to which the felts are subject have become more severe, and it has been a challenge to produce a belt in which compression recovery and felt thickness are maintained so that felt has a satisfactory useful life.

Various proposals for structures which maintain compressibility and recoverability have been made.

One such proposal, described in Japanese Utility Model Registration No. 2514509, is a felt comprising a base fabric woven of thread, and a staple fiber integrated by needle punching with the base fabric. This felt uses fibers which exhibit elasticity as the threads of the base fabric or as the staple fiber. Fibers comprising a polyamide block copolymer which has hard segments composed of polyamide components and soft segments composed of polyether components, can be used as the elastic fibers.

On the other hand, for the purpose of improving compressibility and recoverability, a different felt structure, which does not comprise a base fabric and a staple fiber, has been proposed in Unexamined Japanese Patent Publication No. 504167/2001. In this felt, as shown in FIG. 18, a base body 20A comprises not just a woven fabric 20A1, but also a compact, mesh-shaped, thermoplastic resin sheet 20A2, and a multi-filament reinforcing yarn 20A3, the yarns being surrounded by a synthetic rubber material.

As shown in FIG. 19, another press felt has a layer of a three-dimensional knitted fabric, comprising two pieces of fabric 44A and 46A, and connecting fibers 48A connecting the two pieces of fabric. The connecting fibers 48A connect corresponding front and back stitches of the fabrics 44A and 46A, and these two pieces of fabric are supported by the connecting fibers 48A. Compression recoverability and the ability to maintain thickness can be improved by providing this three-dimensional knitted fabric in the felt, since, even when the three-dimensional knitted fabric is compressed under load, when the load is removed, the connecting fibers 48A recover their original form in the direction of the thickness of the three-dimensional fabric.

In the felt made in accordance with the first of the above-described proposals, recoverability diminished over repeated passage through the press part, due to the crushing of air voids formed between staple fibers.

In the case of the structure shown in FIG. 18, where an elastic structure, comprising a sheet 20A2 and reinforcement yarns 20A3, is used for improving the sustainability of the felt's thickness, the elastic structure is not compressed easily. As a result, its compression recoverability is not very different from that of the felt shown in FIG. 17, which has no elastic structure.

A press felt having a three-dimensional knitted fabric as shown in FIG. 19 exhibits improved compression recoverability and improved ability to maintain thickness to some extent. However, since the connecting fibers 48A, between the two pieces of fabric 44A and 46A, connect only corresponding front and back stitches of the respective pieces of fabric, the forces exerted on the connecting fibers during compression of the felt are exerted perpendicular to the stitch lines and tend to push all of the connecting fibers in the same direction. Consequently the elasticity of the press felt, its compression recoverability, and the ability of the felt to maintain its thickness are not entirely satisfactory. Furthermore if the connecting fibers are all pushed down in the direction of the width of the press felt, the press felt vibrates in the direction of the axes of the press rolls.

In view of the above problems, the principal object of this invention is to provide a papermaking press felt having superior compression recoverability and a superior ability to maintain its thickness. It is also an object of the invention to provide a method of manufacture of such a press felt.

SUMMARY OF THE INVENTION

The press felt in accordance with the invention comprises a base body and a fibrous assembly. The press felt includes a layer of a three-dimensional knitted fabric comprising two pieces of fabric and connecting fibers connecting the two pieces of fabric. The three-dimensional knitted fabric is provided within the press felt at a distance from both the wet paper web contact surface and the machine contact surface, and at least some of the connecting fibers connect the two pieces of fabric diagonally.

The diagonal connecting fibers function as diagonal bracing, preventing the connecting fibers that connect corresponding opposed stitches of the two fabrics from being pulled over as the felt is compressed. The diagonal fibers may connect wale stitches or course stitches of the respective fabrics. The connected stitches are displaced rather than directly opposite each other. In comparison with a press felt having a three dimensional knitted fabric in which all the connecting fiber are perpendicular to the knitted fabric layers, the press felt having diagonal connecting fibers in its three dimensional knitted fabric exhibits superior compression recoverability and a superior ability to maintain its thickness at high level over a long time. In addition, since the connecting fibers are prevented from being pulled over, vibration of the felt in the axial direction of the press rolls, which has been found to occur in the case of previously proposed felts incorporating three-dimensional knitted fabrics, is prevented.

The connecting fibers, as well as each of the two pieces of fabric, preferably comprise monofilament fibers.

The layer of three-dimensional knitted fabric may be provided on the wet paper web contact surface side or on the machine contact surface side relative to the base body. An additional base body may be included, and, in that case, the layer of three-dimensional knitted fabric is preferably provided between the base bodies.

In one preferred embodiment, the layer of three-dimensional knitted fabric and said base body are in contact with each other.

In another preferred embodiment, a part of the fibrous assembly is provided between the layer of three-dimensional knitted fabric and the base body.

The layer of three-dimensional knitted fabric may be bonded to the fibrous assembly, or the three-dimensional knitted fabric and the fibrous assembly may be integrated by needle punching.

The layer of three-dimensional knitted fabric may be formed by spirally winding a three-dimensional knitted fabric having a width smaller than that of the press felt, or by forming a plurality of closed loops of three-dimensional knitted fabric strips in coaxial, side-by-side relationship, each strip having a width smaller than that of the press felt. Alternatively, the layer of three-dimensional knitted fabric may be formed by forming a closed loop from a three-dimensional knitted fabric having the same width as that of the press felt.

BRIEF DESCRIPTION OF THE DRAWINGS

FIG. 6(*b*) is a side view of the knitted fabric as seen in the direction of arrow b of FIG. 6(*a*);

FIG. 6(*c*) is a side view seen of the knitted fabric as seen the direction of arrow c of FIG. 6(*a*);

DETAILED DESCRIPTION OF THE PREFERRED EMBODIMENTS

Figure 6:
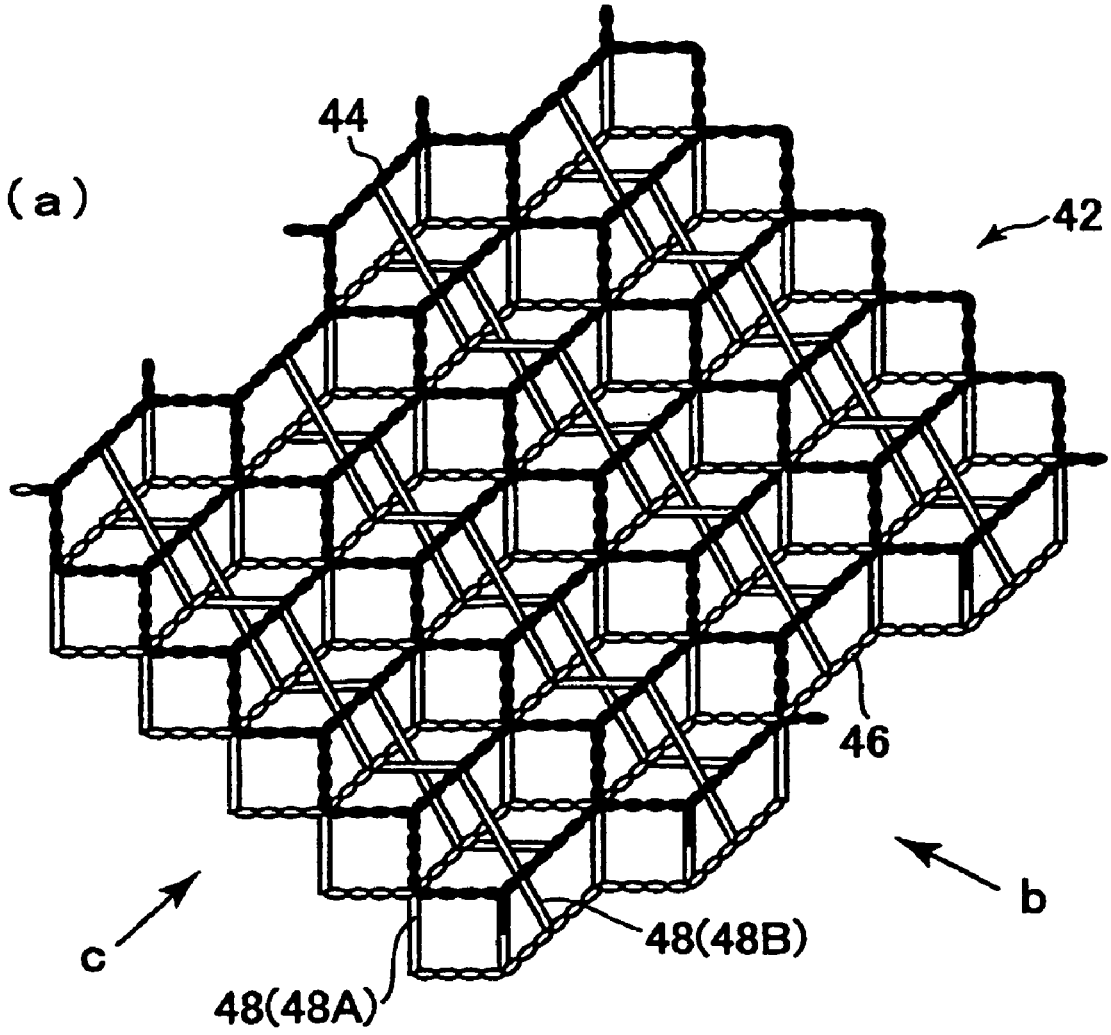
FIG. 6(*a*) is a perspective view of a three-dimensional knitted fabric.
Figure 6:
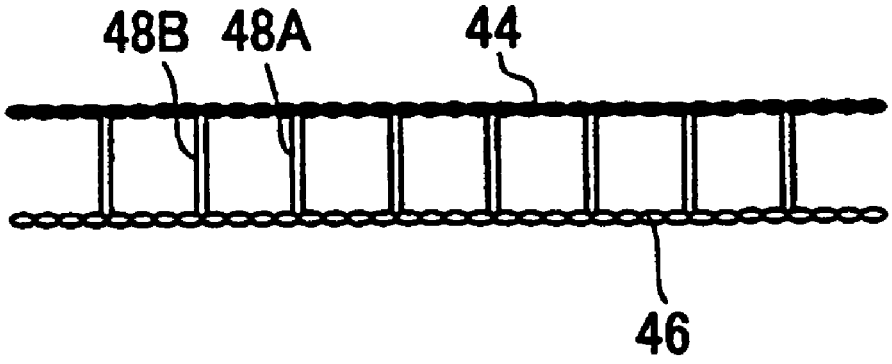
Figure 6:
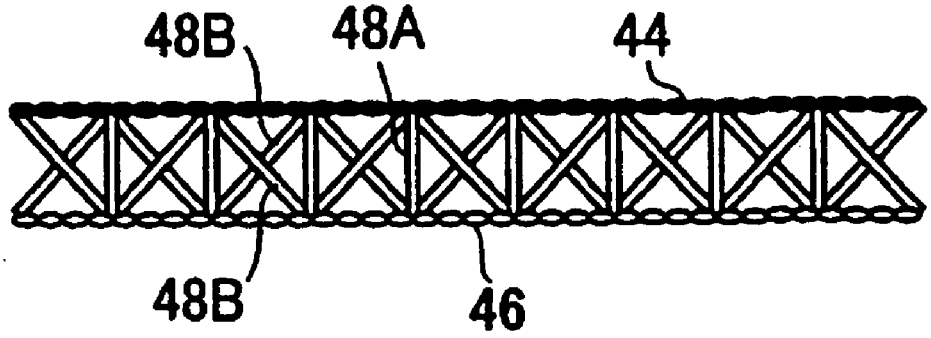

As shown in FIGS. 6(*a*), 6(*b*) and 6(*c*), the three-dimensional knitted fabric 42 in accordance with the invention comprises a first fabric 44, shown as an upper layer, a second fabric 46, shown as a lower layer, and connecting fibers 48, which connect the first fabric 44 and the second fabric 46. So that the fabrics may be distinguished from each other in the drawings, the first fabric 44 is shown by connected black dots and the second fabric 46 is shown by connected white dots.

The connecting fibers 48 are disposed between the first fabric 44 and the second fabric 46. In this case, both the first fabric 44 and the second fabric 46 are knitted by a wale stitch, which is in the direction of the length of the fabric, and a course stitch which is in a direction of width of the fabric.

The connecting fibers 48 comprise two kinds of connecting fibers: perpendicular connecting fibers 48A, and diagonal connecting fibers 48B. The perpendicular connecting fibers extend perpendicular to the two pieces of fabric 44 and 46, and connect corresponding front and back stitches of the two pieces of fabric. The diagonal connecting fibers 48B connect wale stitches or course stitches of the fabrics at locations spaced from the corresponding front and back stitches connected by the perpendicular connecting fibers. These diagonal connecting fibers connect stitches of the fabrics 44 and 46 which are displaced from, i.e., not directly opposite, each other. The diagonal connecting fibers extend diagonally in two directions. That is one set of fibers extends diagonally in a first direction, and another set of fibers extends diagonally in a second direction. Thus, in the embodiment shown in FIGS. 6(*a*)-6(*c*), fibers 48B of a first set extend upward and toward the right relative to a direction perpendicular to the web and machine contact surfaces, as shown in FIG. 6(*c*), while fibers 48B of the other set extend upward and toward the left, preferably crossing the fibers 48B of the first set.

Figure 7:
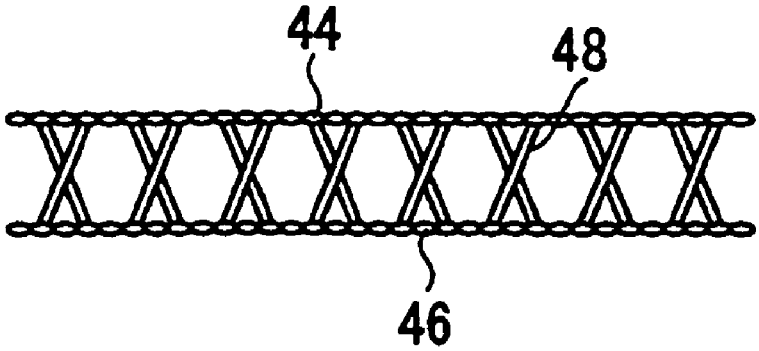
FIG. 7 is side view of another three-dimensional knitted fabric.
Figure 8:
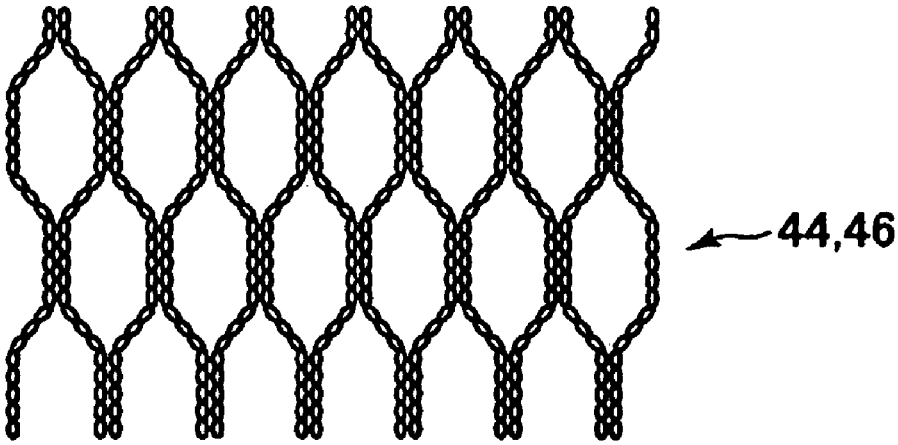
FIG. 8 is a plan view of a three-dimensional knitted fabric.
Figure 9:
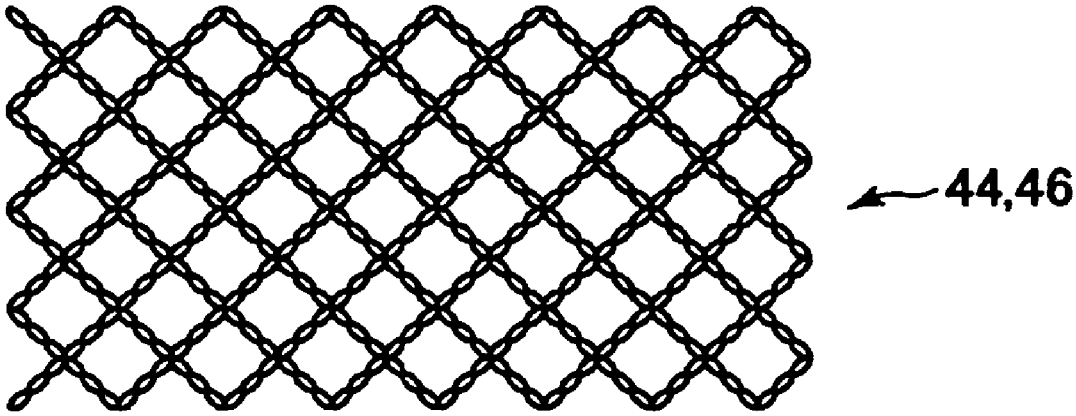
FIG. 9 is a plan view of another three-dimensional knitted fabric.

In addition, well-known structures described in, for example, Unexamined Japanese Patent Publications No. 31241/1986, No. 74648/1990, No. 229247/1990, and No. 234456/2001, can be adopted for the structure of the three-dimensional knitted fabric 42, as long as some of the connecting fibers 48 are disposed diagonally in between the first fabric 44 and the second fabric 46. Thus, a hexagonal mesh as shown in FIG. 8, or a diamond mesh as shown in FIG. 9 are suitable for use as the first or the second fabric. Although three dimensional knitted fabrics having both perpendicular and diagonal connecting fibers are suitable for use in press felts according to the invention, optionally a three dimensional knitted fabric such as the one illustrated in FIG. 7, where all the connecting fibers are diagonal fibers, may be used.

The improved compression recoverability and the improved ability to maintain thickness, achieved by the use of connecting fibers which are diagonally disposed relative to the thickness direction, are due to the improved ability of the three-dimensional knitted fabric to recover its original form in the thickness direction after a compressive load is removed. A remarkable improvement in compression recovery, and in thickness maintenance has been observed in comparing a felt having a three-dimensional knitted fabric having diagonally disposed connecting fibers with a felt having no diagonal connecting fibers. That is, a press felt in which diagonal connecting fibers are present in the three-dimensional knitted fabric has a superior compression recovery in the overall felt, as compared with a felt structure having a three dimensional knitted fabric in which the layers are connected solely by perpendicular connecting fibers.

When at least some of fibers connecting the first and the second fabrics are diagonal, the connecting fibers can be prevented from being pulled over during compression, and consequently fluctuating movement of the felt along a direction parallel to the axes of the press rolls can be prevented.

A nylon monofilament, which exhibits excellent flex fatigue resistance, is suitable for the connecting fibers 48. Preferably, the fineness of the nylon monofilament connecting fibers is in the range of 50 to 500 dtex. The three-dimensional knitted fabric should have a basis weight in the range from 100 to 800 g/m$^2$, preferably 300 to 600 g/m$^2$.

Various configurations of press felts incorporating one or more three-dimensional knitted fabrics 40 are illustrated in FIGS. 1-5. In each case, a press felt 10 comprises one or more base bodies 20, a fibrous assembly 30, and one or more layers 40 of a three-dimensional knitted fabric. Each press felt has a wet paper web contact surface 11 and a machine contact surface 12.

Figure 1:
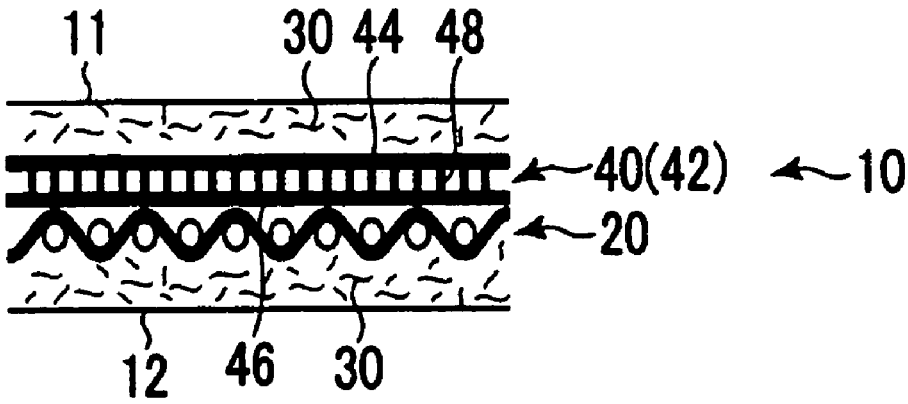
FIGS. 1(*a*) and 1(*b*) are schematic sectional views illustrating the distribution and formation of a three-dimensional knitted fabric of a press felt according to the invention.
Figure 1:
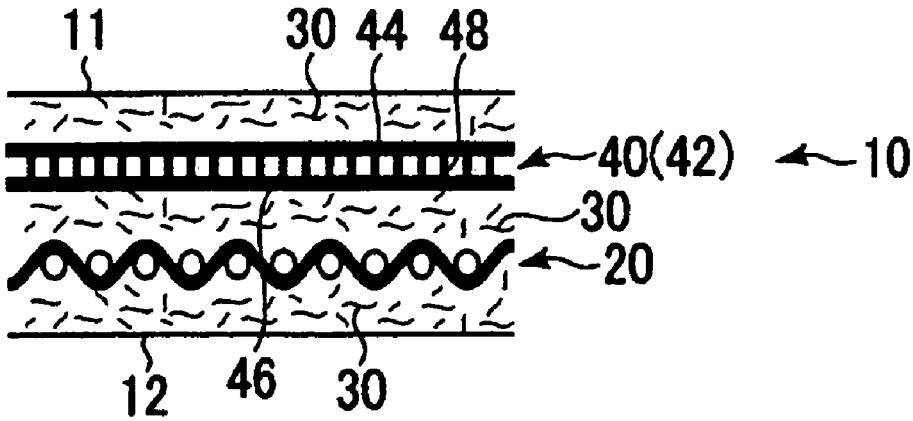

As shown in FIGS. 1(*a*) and 1(*b*), a three-dimensional knitted fabric layer 40 is provided between a base body 20 and a wet paper web contact surface 11. The base body 20 and the three-dimensional knitted fabric layer 40 can be in contact with each other as shown in FIG. 1(*a*), or a part of the fibrous assembly 30 can be provided between the base body 20 and the layer 40, as shown in FIG. 1(*b*).

Figure 2:
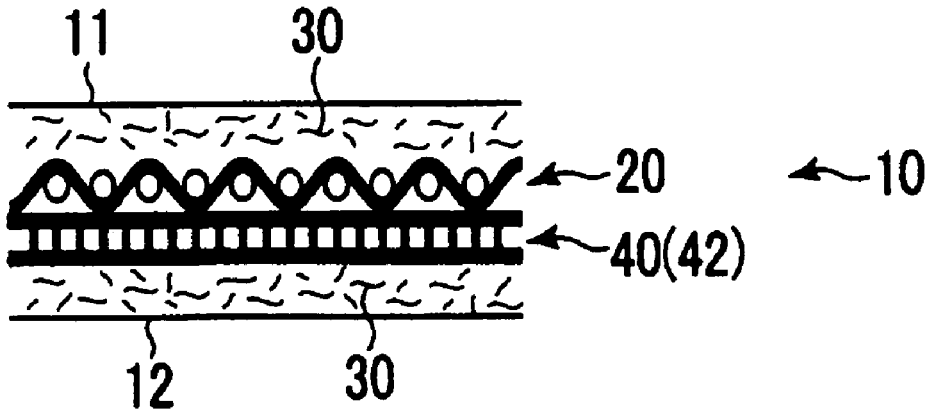
FIGS. 2(*a*) and 2(*b*) are schematic sectional views illustrating the distribution and formation of a three-dimensional knitted fabric of another felt according to the invention.
Figure 2:
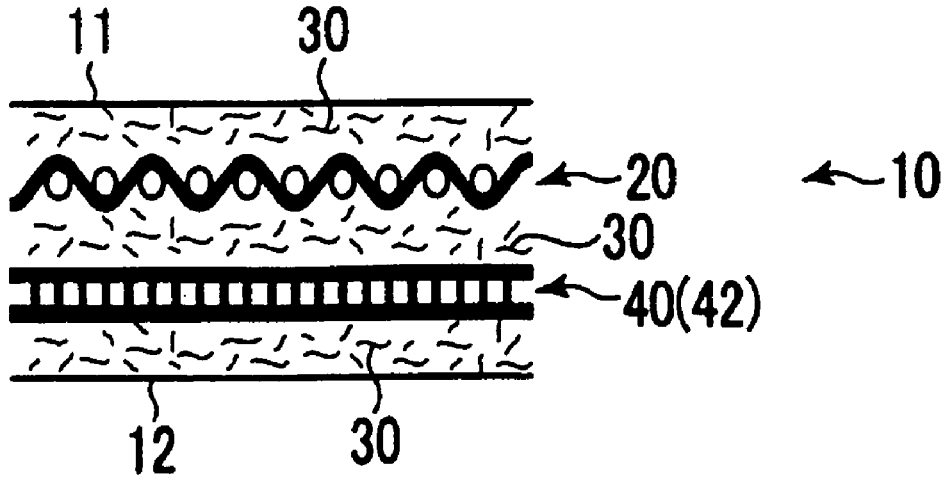

Alternatively, as shown in FIGS. 2(*a*) and 2(*b*) the layer 40 of three-dimension knitted fabric can be provided between the base body 20 and the machine contact surface 12. Here again, the base body 20 and the layer 40 can be in contact with each other as shown in FIG. 2(*a*), or a part of the fibrous assembly 30 can be provided between the base body 20 and the layer 40, as shown in FIG. 2(*b*).

The three-dimensional knitted fabric layer 40 can be provided in a press felt having two base bodies 20. If the three-dimensional knitted fabric layer 40 is provided between one of the base bodies and the wet paper web contact surface, or between the other base body and the machine contact surface, the structures will be similar to those of FIGS. 1(*a*), 1(*b*), 2(*a*) and 2(*b*), except that an additional base body will be present.

Figure 3:
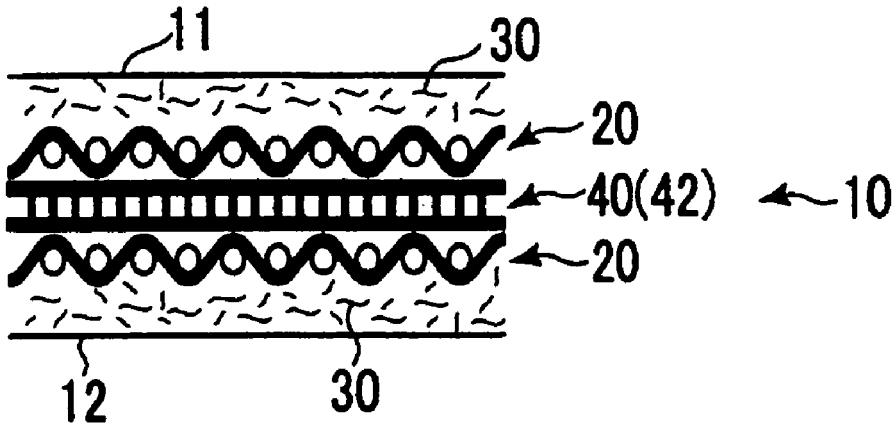
FIGS. 3(*a*)-3(*d*) are schematic sectional views illustrating the distribution and formation of a three-dimensional knitted fabric of still another felt according to the invention.
Figure 3:
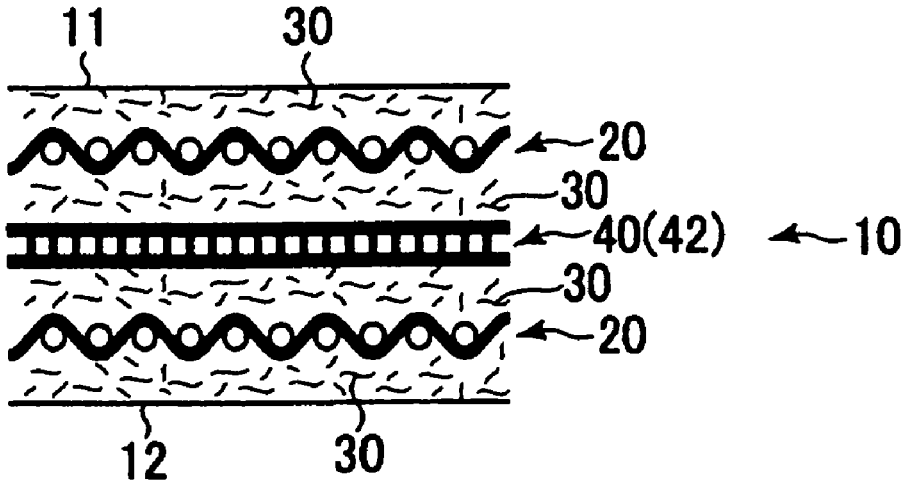
Figure 3:
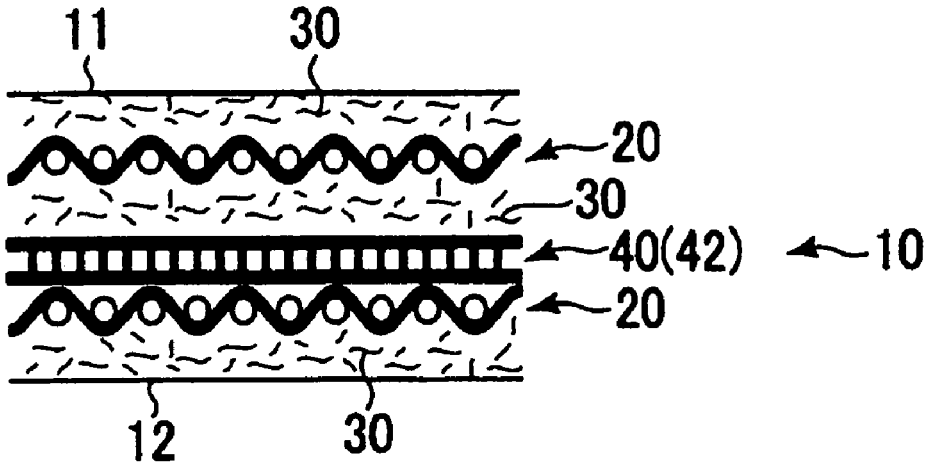
Figure 3:
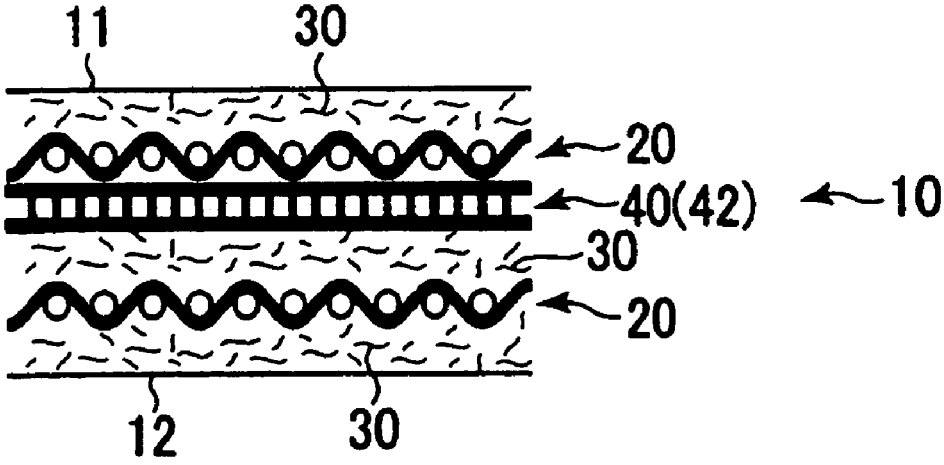

On the other hand, as shown in FIGS. 3(*a*)-3(*d*), the three-dimensional knitted fabric layer 40 can be provided between base bodies 20. FIG. 3(*a*) shows a structure in which both base bodies 20 are in contact with and the three dimensional knitted fabric layer 40. FIG. 3(*b*) shows an embodiment in which a part of the fibrous assembly 30 is provided between each base body 20 and the three-dimensional knitted layer 40. In FIG. 3(*c*), a part of the fibrous assembly 30 is provided between the base body 20 nearest the wet paper web contact surface 11 and the layer 40, whereas the base body 20 nearest the machine contact surface 12 is in contact with layer 40. Conversely, in the structure shown in FIG. 3(*d*), the base body 20 nearest the wet paper web contact surface 11 is in contact with layer 40, but a part of the fibrous assembly 30 is provided between layer 40 and the base body 20 nearest the machine contact surface 12.

Figure 4:
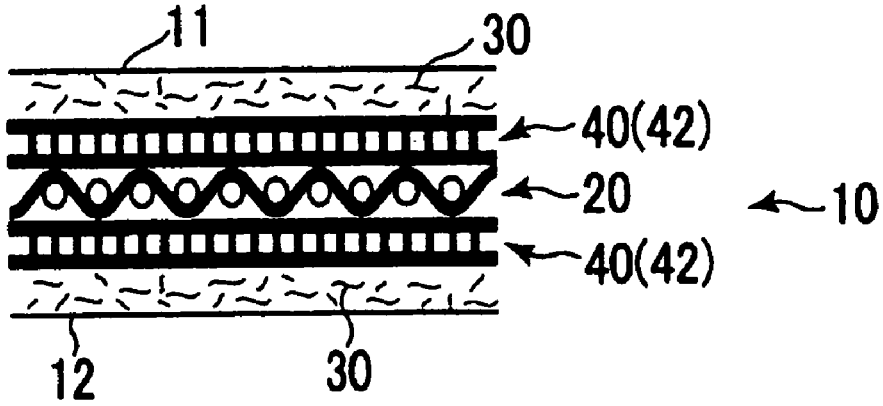
FIGS. 4(*a*)-4(*d*) are schematic sectional views illustrating the distribution and formation of a three-dimensional knitted fabric of still another felt according to the invention.
Figure 4:
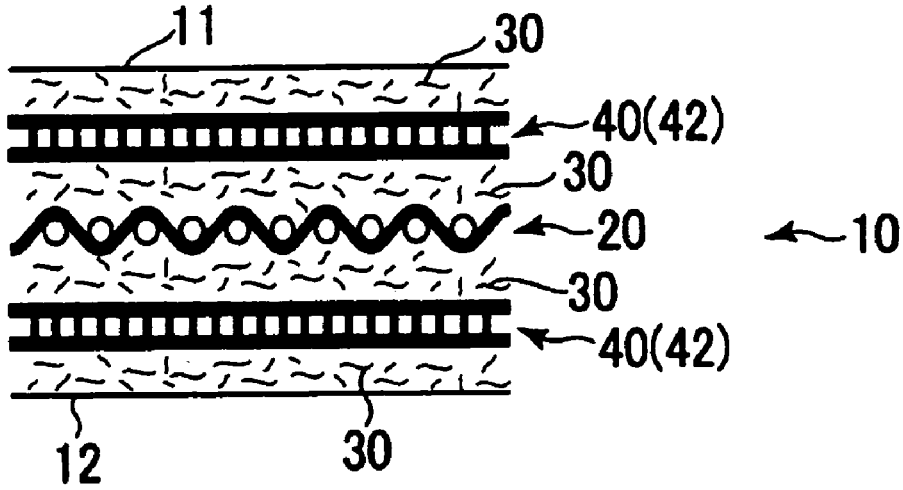
Figure 4:
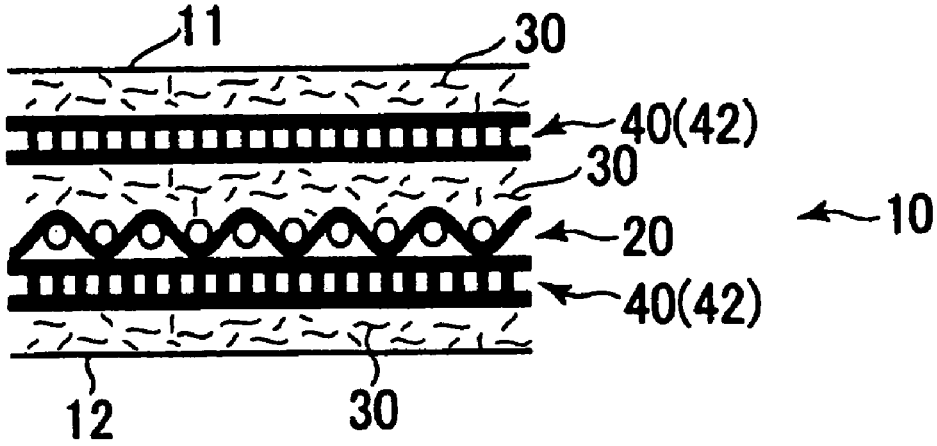
Figure 4:
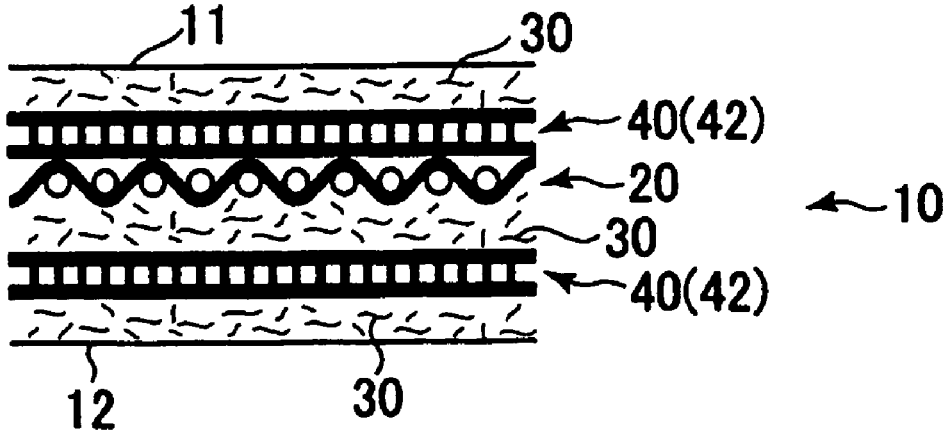

Furthermore, as shown in FIGS. 4(*a*)-4(*d*), three-dimensional knitted fabric layers 40 can be provided, on both sides of a base body 20, respectively between the base body and the wet paper web contact surface 11 and between the base body 20 and the machine contact surface 12. As shown in FIG. 4(*a*), both layers 40 are in contact with the base body. In FIG. 4(*b*), parts of the fibrous assembly 30 are provided between the base body 20 and each three-dimensional knitted fabric layer 40. As shown in FIG. 4(*c*), a part of the fibrous assembly 30 is provided between the layer 40 nearest the wet paper web contact surface 11 and the base body 20, whereas the other layer 40, nearest the machine contact surface 12, is in contact with the base body 20. Conversely, as shown in FIG. 4(*d*), the three-dimensional knitted fabric layer 40 nearest the wet paper web contact surface side 11 is in contact with the base body, whereas a part of the fibrous assembly 30 is provided, on the opposite side of the base body 20, between the base body and the three-dimensional knitted fabric layer 40 nearest the machine contact surface 12.

Figure 5:
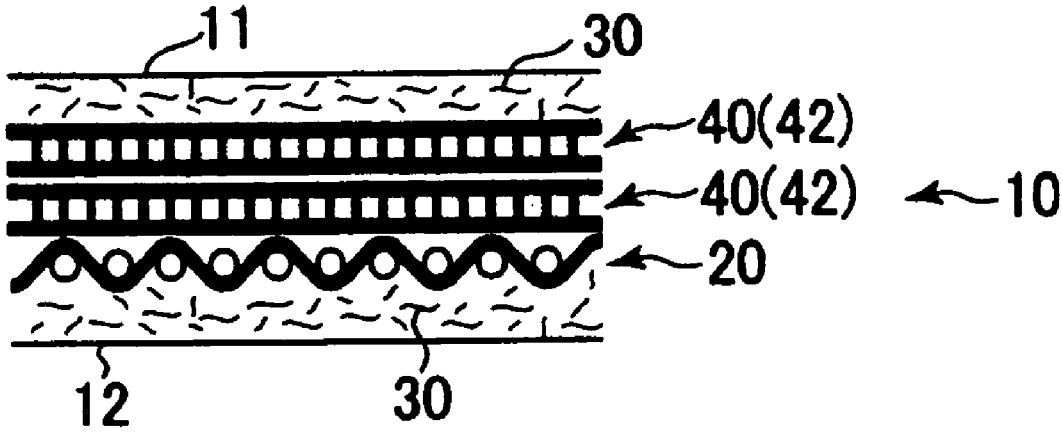
FIG. 5 is a schematic sectional view illustrating the distribution and formation of a three-dimensional knitted fabric of a felt according to the invention.

A plurality of layers of three-dimensional knitted fabric can be provided between a base body 20 and the wet paper web contact surface 11, as shown in FIG. 5, or between the base body 20 and the machine contact surface 12. It can be appropriately decided whether a base body 20 and a layer 40 of a three-dimensional knitted fabric are in contact with each other, whether two layers 40 of three-dimensional knitted fabrics are in contact with each other, and whether a fibrous assembly 30 is provided between any of the adjacent internal components of the press felt.

Problems can arise in the use of some of the various press felt structures described above, and can be overcome by suitable countermeasures. When a three-dimensional knitted fabric layer 40, formed on the machine contact surface side 12, comes into contact with a grooved roll, abrasion of the machine contact surface 12 must be considered. To prevent exposure and breakage of the three-dimensional knitted layer 40 due to abrasion, the amount of fiber in the fibrous assembly which forms a machine contact surface 12 may be increased.

Because of the foregoing problem of abrasion, a felt in which the three dimensional knitted layer 40 is on the wet paper web contact side 11 of the base body is preferable. However, in this case, there is another concern, namely, that the pattern of the three-dimensional knitted fabric may be transferred to the wet paper web. Therefore, when the three dimensional knitted fabric 40 is provided on the wet paper web contact side of the base body, an increased amount of fiber in the part of the fibrous assembly at the wet paper web contact surface 11, and/or a structure in which the knitted fabric has a shorter stitch length, may be used. Preferably, the opening ratio of the surface of the fabric is 50% or less, and the size of the openings surrounded by fibers is 0.03 cm$^2$ or less.

Both of the above problems can be addressed by providing base bodies 20 respectively on the machine contact side and the wet paper web contact side of a three dimensional knitted layer 40, as shown in FIGS. 3(*a*)-3(*d*). In these embodiments, the abrasion problem on the machine contact surface 12, and the pattern transfer problem on the wet paper web contact surface 11, are not likely to arise.

Preferably a part of the fibrous assembly 30 is provided between the three dimensional knitted layer fabric and each base body 20. The three-dimensional knitted fabric 40 and the base body 20 are connected tightly by the fibrous assembly 30, so that the structure has greater strength, as compared with a structure in which no part of the fibrous assembly 30 is provided between the knitted fabric and the base body.

For the base body 20, which imparts strength to the whole press felt, various structures can be adopted. A cloth woven from machine direction threads and cross-machine direction threads, a non-woven structure formed by piling machine direction threads and cross-machine direction threads instead of weaving them, and a structure formed by winding a cloth, may be used, for example. On the other hand, the fibrous assembly 30 is an assembly of staple fibers. In a press felt for papermaking 10, staple fibers can be accumulated on a base body 20 or on a three-dimensional knitted fabric layer 40, and intertwiningly integrated with the base body or three dimensional knitted layer by needle punching. It is also possible to utilize a non-woven fabric comprising an assembly of staple fibers which are intertwiningly integrated by needle punching, placing the integrated staple fiber assembly on a base body 20 or on a three-dimensional knitted layer 40, and intertwiningly integrating the assembly of staple fibers with the base body 20 or the three dimensional knitted layer 40 by needle punching.

In addition, the fibrous assembly 30 can be bonded, by adhesion, with the base body 20 or with the three-dimensional knitted fabric layer 40. However, for a connection having the greatest strength, it is preferable to integrate the fibrous assembly with the base body or knitted layer by needle punching, In addition, when the fibrous assembly 30 is integrated with the three-dimensional knitted fabric 42 by needle punching, fibers enter into the three-dimensional knitted fabric. When the amount of fiber entering the three-dimensional knitted fabric is excessive, the effects of the connecting fibers 48 in the three-dimensional knitted fabric 42 decrease, and, as a result, compression recoverability and thickness sustainability, are impaired. Therefore, attention should be paid to the amount of fiber which enters into the three-dimensional knitted fabric 42. Preferably, the three-dimensional knitted fabric 42 has the density in the range from of 0.1 g/cm$^3$ to 0.4 g/cm$^3$, even when fibers from the fibrous assembly 30 have already entered into the three-dimensional knitted fabric.

In addition, care should be taken not to curve or bend the connecting fibers 48 significantly when a fibrous assembly 30 is integrated with a three-dimensional knitted fabric 42 by needle punching.

The three-dimensional knitted fabric layer 40 can be formed from a length a three-dimensional knitted fabric having the same width as the press felt being produced, by bringing the ends of the length of fabric together, thereby forming a closed loop.

Figure 10:
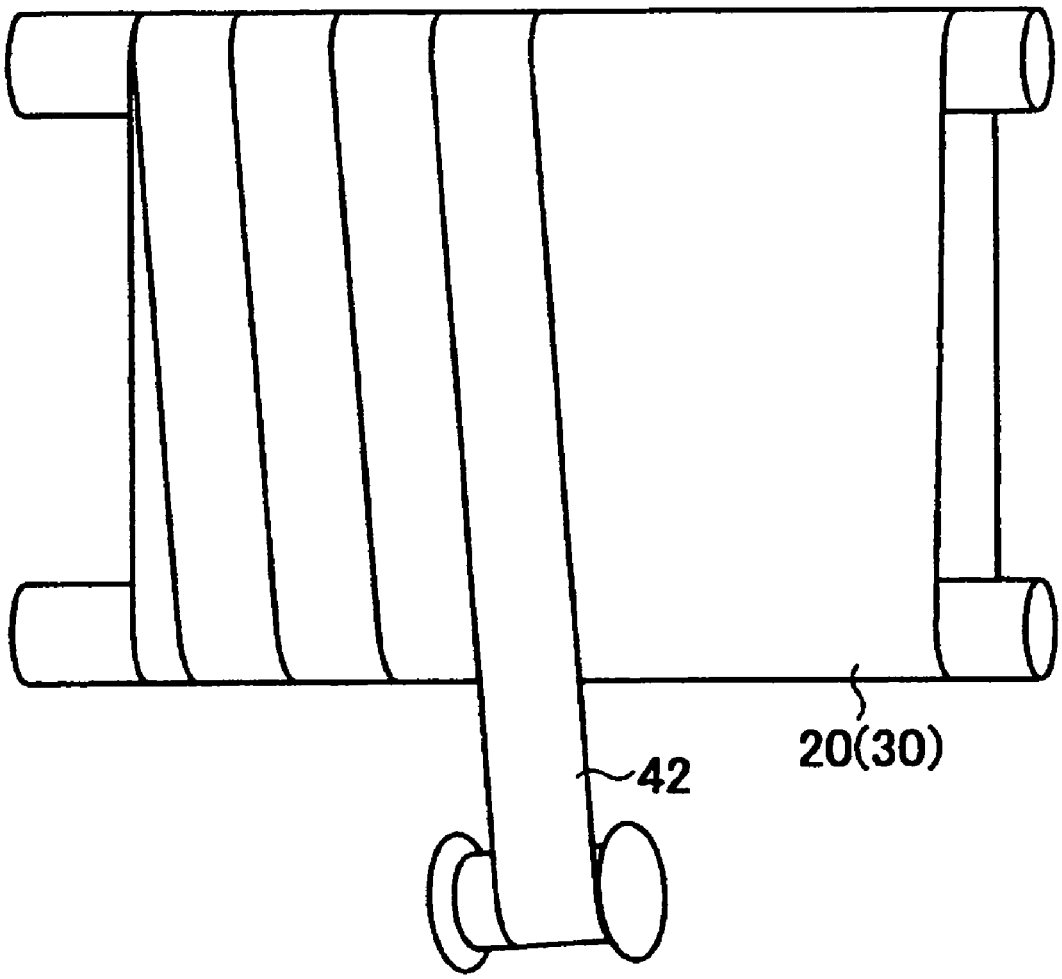
FIG. 10 is a schematic view illustrating a method of distributing a three-dimensional knitted fabric.
Figure 11:
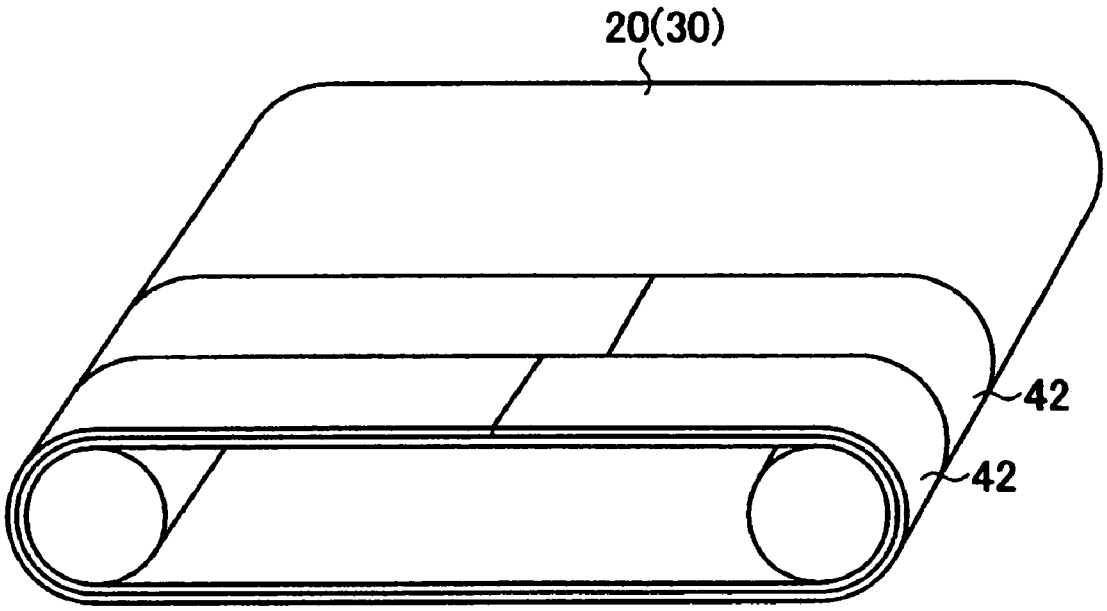
FIG. 11 is a schematic view illustrating another method of distributing a three-dimensional knitted fabric.

On the other hand, a three-dimensional knitted fabric 42, having a width smaller than that of the press felt can also be used. In this case, as shown in FIG. 10, a layer of three-dimensional knitted fabric can be provided, by winding the three-dimensional knitted fabric 42 in a spiral on an endless base body 20 or a fibrous assembly 30 stretched between two rolls, and then connecting the adjacent windings of three-dimensional knitted fabric 42. Alternatively, as shown in FIG. 11, a three-dimensional knitted fabric layer can be provided by forming separate lengths of three-dimensional knitted fabric 42 into closed loops by bringing both ends of each length of fabric together, and disposing the loops thus formed in parallel, side-by-side, coaxial relationship.

In the above examples, a belt-like loop of three-dimensional knitted fabric is formed on a base body before it is integrated with a fibrous assembly 30. Alternatively, the fibrous assembly 30 can be integrated with a three-dimensional knitted fabric 42 before the three-dimensional knitted fabric 42 is disposed on a base body 20. When this process is chosen, the composite consisting of the fibrous assembly and the three-dimensional knitted fabric can be provided on, and connected to, the base body. In this case, the process of integrating a fibrous assembly 30 with base body or three-dimensional knitted fabric can be omitted or simplified.

Examples of the invention will be explained, referring to FIGS. 12(*a*), 12(*b*) and 13.

Figure 12:
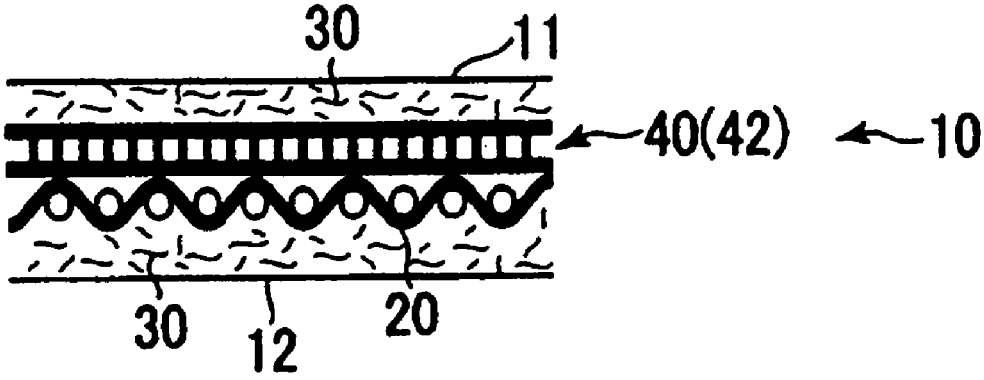
FIGS. 12(*a*) and 12(*b*) are cross-sectional views respectively of an example of a felt in accordance with the invention and a comparative example.
Figure 12:
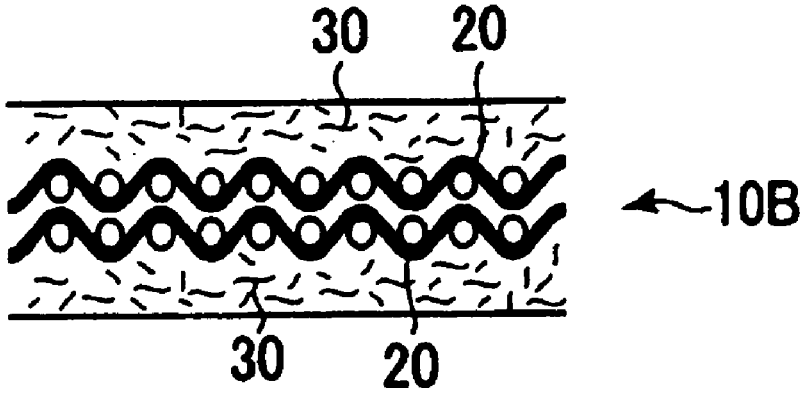

FIG. 12(*a*) is a cross-sectional view of a felt 10 in accordance with Example 1, a first example of the invention. In the felt 10, the base body 20 was a woven fabric, woven from machine direction threads and cross machine direction threads. A three-dimensional knitted fabric layer 40 is in contact with, and connected to, the base body 20, and a fibrous assembly 30 is intertwiningly integrated with the base body 20 and the layer 40 by needle punching. The three dimensional knitted layer 40 comprises two pieces of fabric and connecting fibers connecting the two pieces of fabric, wherein some of the connecting fibers are disposed diagonally in between the two pieces of fabric. The two pieces of fabric comprise multi-filament yarns, but the connecting fibers comprise monofilament yarns. The ratio of the number of perpendicular fibers, which connect corresponding, opposed, front and back stitches of the fabrics, to the number of diagonal connecting fibers, was approximately 1 to 1.

Example 2 of the invention had the same basic structure as that of the felt of Example 1, except that, in the layer of three-dimensional knitted fabric, both of the two pieces of fabric, and the connecting fibers, were composed of monofilament yarns.

Comparative Example 1 had the same basic structure as that of the felt of Example 1, except that all the connecting fibers in the layer of a three-dimensional knitted fabric were disposed almost perpendicular to the knitted fabric layers instead of being disposed diagonally.

FIG. 12(*b*) is a cross-sectional view of Comparative Example 2. The felt 10B of Comparative Example 2 comprises two base bodies 20 disposed in face-to-face relationship, and staple fibers 30 integrated with both sides of the base body structure by needle punching. The two base fabrics bodies are also integrated with each other by the staple fibers in the process of needle punching.

To standardize the conditions of the four examples, the basis weights (in g/m$^2$) of all the felts were made equal. In addition, in the felt 10B (FIG. 12(*b*)) of Comparative Example 2, the basis weight was made equal to that of Example 1, Example 2 and Comparative Example 1, by adjusting the basis weight of one base body 20 and the fibrous assembly 30. In addition, in Examples 1 and 2, and Comparative Examples 1 and 2, an identical structure was used for the fibers forming the base body 20 and the fibrous assembly 30.

Figure 13:
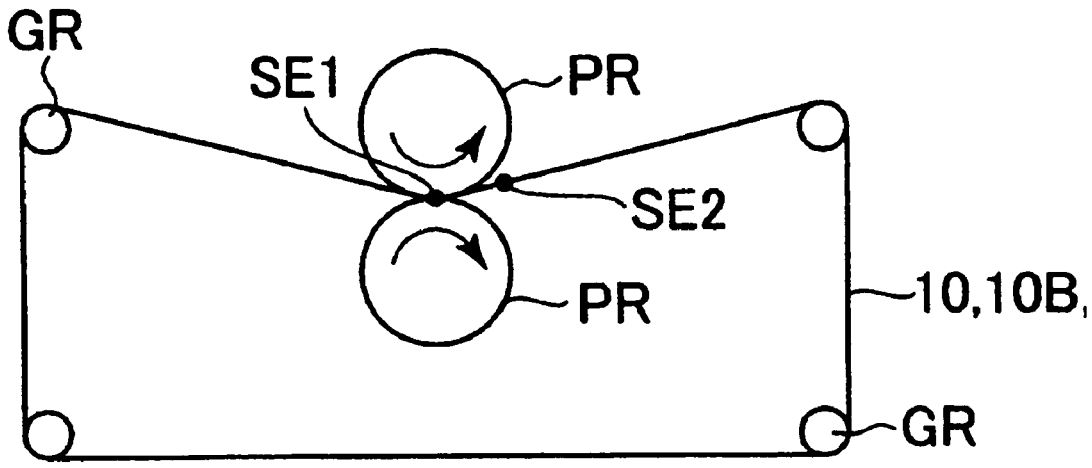
FIG. 13 is a schematic view of an apparatus for evaluating compression recoverability, and the ability to maintain thickness of a press felt.
Figure 14:
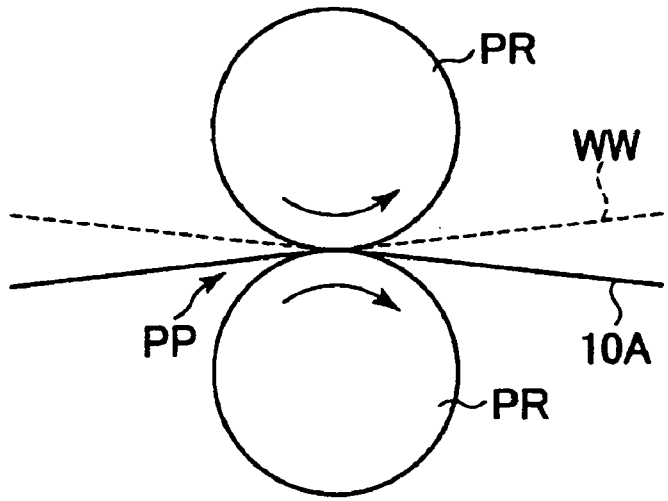
FIGS. 14, 15 and 16 are schematic view of the press parts of three different papermaking machines.
Figure 15:
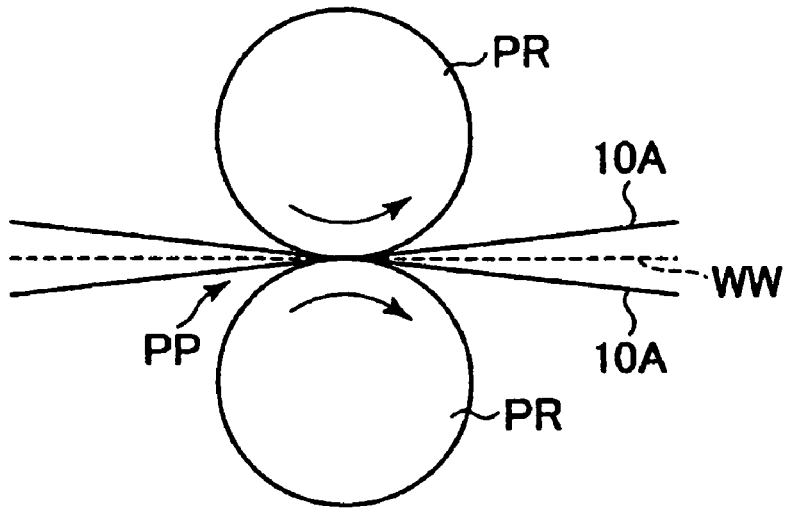
Figure 16:
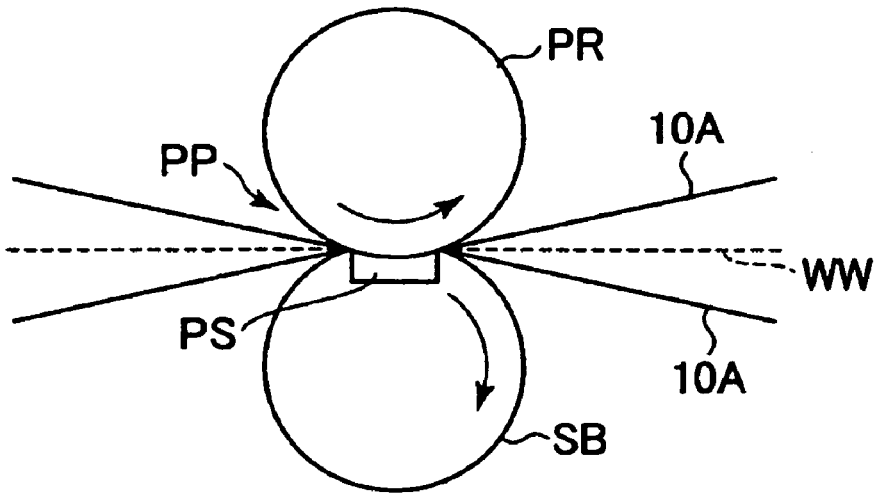
Figure 17:
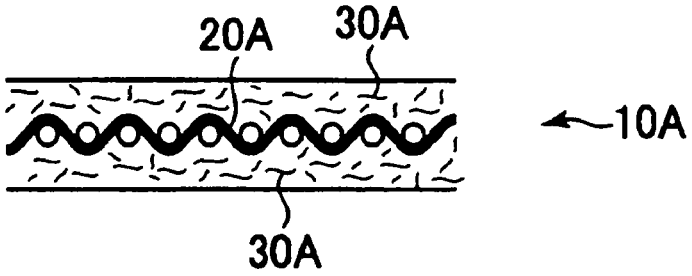
FIG. 17 Prior Art
FIG. 17 is a cross-sectional view of a conventional press felt.
Figure 18:
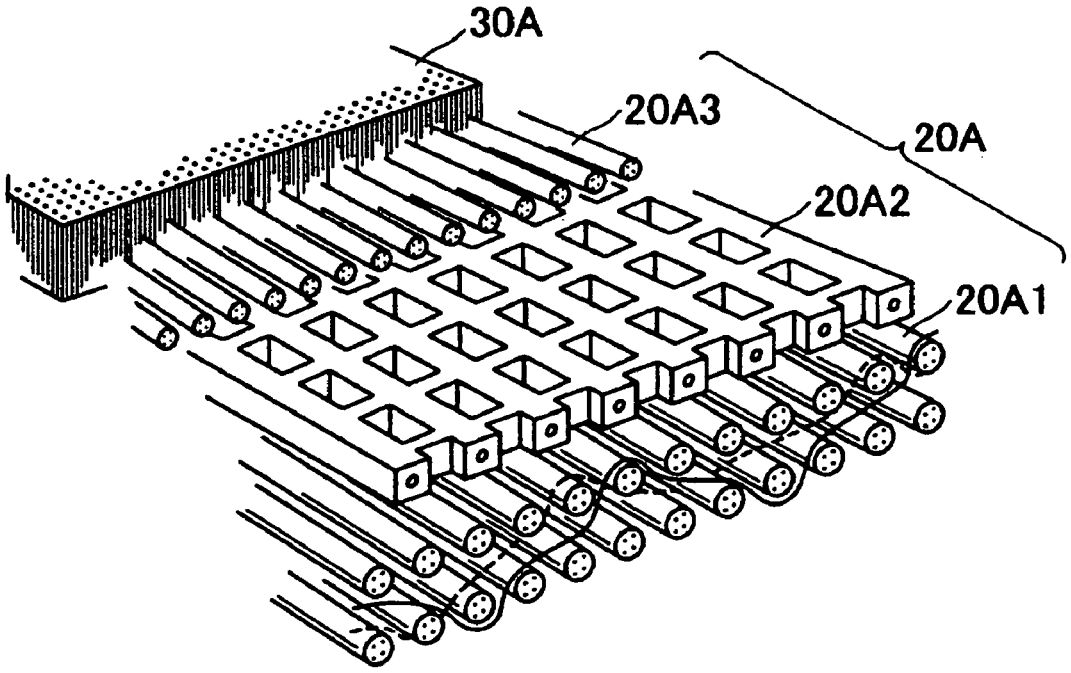
FIG. 18 Prior Art
FIG. 18 is a perspective view of a conventional press felt.
Figure 19:
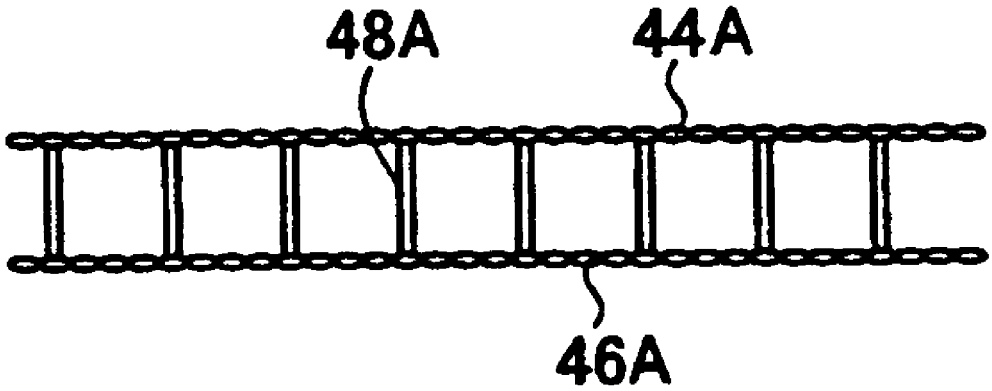
FIG. 19 Prior Art
FIG. 19 is a side view of a three-dimensional knitted fabric provided for a conventional press felt.

Experiments were conducted using the test apparatus shown in FIG. 13. Compression recoverability, the ability to maintain thickness, fluctuation in the compression direction and in the axial direction of the press rolls, and drainage of the felts of Examples 1 and 2, and Comparative Examples 1 and 2, were examined.

The test apparatus of FIG. 13 had a pair of press rolls PR, guide rolls GR, supporting, and applying constant tension to, the felt, a first sensor SE1, measuring the thickness of the felt under direct pressure exerted by the pair of press rolls PR, and a second sensor SE2, measuring the thickness of the felt immediately after the pressure is released.

The upper press roll PR rotates and exerts pressure on the lower press roll PR, and consequently, the felts 10 and 10B, which are supported by the guide rolls GR are driven along with rotation of the press rolls PR.

The conditions of operation of the test apparatus were as follows. The press pressure was 100 kg/cm, and the felt driving speed was 1000 m/minute. The experiment was continued for 120 hours.

Compression recoverability of the felts of was calculated by substituting the measured values of $t_1$ and $t_2$ into the formula $(t_2-t_1)/t_1\times100$, where $t_1$ is the thickness (mm) of a felt under nip pressure as determined by sensor SE1, and $t_2$ was the thickness (mm) of the felt out of the nip pressure as determined by sensor SE2.

Numerical values were measured both at the time immediately after the experiment began, and at the time when the experiment ended. A standard value of 100 was assigned to the compression recoverabilty of Comparative Example 1, measured at the time immediately after the experiment began. The compression recoverability of Examples 1 and 2, and Comparative Example 2, was evaluated relative to this standard value of 100. In order to make a valid comparison of the examples, a normalization factor (that is, a multiplier) was determined such that, when $(t_2-t_1)/t_1\times100$ for Comparative Example 1 is multiplied by that factor, the result is a compression recoverability figure of 100. The same normalization factor is applied to the formula to arrive at compression recoverability values for Examples 1 and 2, and Comparative Example 2. From the formula, it will be apparent that a higher value corresponds to a better evaluation and a lower value corresponds to a worse evaluation.

The ability of the felts to maintain thickness was calculated by substituting values for $u_1$ and $u_2$ into the formula $u_2/u_1\times100$, where, $u_1$ is the thickness (mm) of a felt out of nip pressure, as determined by sensor SE2, immediately after the beginning of the test, and $u_2$ is the thickness (mm) of a felt, as determined by sensor SE2, at the end of the test. A standard value of 100 was assigned to the thickness maintainability of Comparative Example 1, and the ability of Examples 1 and 2, and Comparative Example 2, to maintain thickness, was evaluated relative to the standard value of 100. Here, as in the case of the compression recoverability comparison, the formula $u_2/u_1\times100$ was multiplied by a normalization factor such that the value of thickness maintainability for Comparative Example 1 was 100, and the same normalization factor was applied to the formula in determining the thickness maintainability for Examples 1 and 2 and Comparative Example 2. Here again, a higher value corresponds to superior thickness maintenance.

The vibration of the felts of the Examples and the Comparative Examples at the press part was also measured at the beginning of the experiment, using a Mk-300 vibration measuring device from Kawatetsu Advantech Co., Ltd. Two vibration values were measured, one in the compression direction of the press rolls, and the other in an axial direction of the press rolls.

Drainage of the felts was calculated as the reciprocal of the time required for a certain amount of water to permeate through the felts under pressure. Drainage measurements were conducted immediately after the beginning of experiment, and again when the experiment ended. A value of 100 was assigned as the standard value for drainage of Comparative Example 1 immediately after the beginning of the experiment, and the drainage of Examples 1 and 2, and Comparative Example 2, was evaluated relative to this standard.

The results are shown in the following table.

| | COMPRESSION RECOVERABILITY | | | VIBRATION VALUE | | DRAINAGE TEST | |
|---|---|---|---|---|---|---|---|
| | BEGINNING OF TEST | END OF TEST | ABILITY TO MAINTAIN THICKNESS | PRESSURE DIRECTION | AXIAL DIRECTION OF ROLLS | BEGINNING OF TEST | END OF TEST |
| EX. 1 | 106 | 95 | 103 | 0.14 G | 0.06 G | 100 | 93 |
| EX. 2 | 107 | 96 | 103 | 0.14 G | 0.06 G | 107 | 98 |
| COMP. EX. 1 | 100 | 90 | 100 | 0.16 G | 0.09 G | 100 | 90 |
| COMP EX. 2 | 96 | 86 | 99 | 0.21 G | 0.08 G | 105 | 96 |

determined from the experiments that Examples 1 and 2 were able to keep compression recoverability at high level, and also superior in their ability to maintain thickness against repeatedly applied pressure. Accordingly, the felts of Examples 1 and 2 had superior characteristics for use as press felts for papermaking.

Vibrations of Examples 1 and 2 in the compression direction and in the axial direction were relatively small in comparison with those of Comparative Examples 1 and 2. Example 2 exhibited excellent drainage, and it is assumed that this was due to the fact that in Example 2, the two pieces of the fabrics and the connecting fibers of the three-dimensional knitted fabric were made from monofilament fibers.

As explained above, by providing a layer of three-dimensional knitted fabric, in which at least some of connecting fibers are disposed diagonally in between two pieces of fabric, a papermaking press felt having a superior compression recoverability and a superior ability to maintain thickness for a long period of time can be provided.

Furthermore, connecting fibers can be prevented from being pulled over at the time of compression, and consequently vibration of the felt in an axial direction of press rolls can be prevented.

We claim:

1. A press felt for papermaking comprising a base body and a fibrous assembly, said press felt having a wet paper web contact surface and a machine contact surface, and including a layer of a three-dimensional knitted fabric comprising first and second pieces of fabric, both having openings, and connecting fibers connecting the first and second pieces of fabric, the three-dimensional knitted fabric being provided within said press felt at a distance from both the wet paper web contact surface and the machine contact surface and the first piece of fabric having a surface facing said wet paper web contact surface and being closer than the second piece of fabric to the wet paper web contact surface, and at least some of said connecting fibers connecting said first and second pieces of fabric diagonally, in which the openings of said first piece of fabric occupy not more than 50 percent of the area of said surface facing the wet paper web contact surface, and in which the maximum dimension of said openings, in directions parallel to said surface facing the wet paper web contact surface, is not greater than 0.03 $cm^2$.

2. A press felt for papermaking as claimed in claim 1, wherein said connecting fibers comprise monofilament fibers.

3. A press felt for papermaking as claimed in claim 1, wherein each of said first and second pieces of fabric comprises monofilament fibers.

4. A press felt for papermaking as claimed in claim 1, wherein said layer of three-dimensional knitted fabric is provided on the wet paper web contact surface side relative to said base body.

5. A press felt for papermaking as claimed in claim 1, wherein said layer of three-dimensional knitted fabric is provided on the machine contact surface side relative to said base body.

6. A press felt for papermaking as claimed in claim 1, which includes at least one additional base body, and in which said layer of three-dimensional knitted fabric is provided between said base bodies.

7. A press felt for papermaking as claimed in claim 1, wherein said layer of three-dimensional knitted fabric and said base body are in contact with each other.

8. A press felt for papermaking as claimed in claim 1, wherein a part of said fibrous assembly is provided between said layer of three-dimensional knitted fabric and said base body.

9. A press felt for papermaking as claimed in claim 1, wherein said layer of three-dimensional knitted fabric is bonded to said fibrous assembly.

10. A press felt for papermaking as claimed in claim 1, wherein said layer of three-dimensional knitted fabric and said fibrous assembly are integrated by needle punching.

11. A press felt for papermaking as claimed in claim 1, wherein said connecting fibers include diagonal fibers extending in two different directions.

12. A press felt for papermaking as claimed in claim 1, wherein said contact surfaces are parallel to each other, and said connecting fibers include diagonal fibers extending upwardly and toward one side of a direction perpendicular to said contact surfaces, and other diagonal fibers extend upwardly and toward the opposite side of said direction.

13. A method of manufacturing a press felt for papermaking, said press felt comprising a base body and a fibrous assembly, said press felt having a wet paper web contact surface and a machine contact surface, and including a layer of a three-dimensional knitted fabric comprising first and second pieces of fabric, both having openings, and connecting fibers connecting the first and second pieces of fabric, the three-dimensional knitted fabric being provided within said press felt at a distance from both the wet paper web contact surface and the machine contact surface and the first piece of fabric having a surface facing said wet paper web contact surface and being closer than the second piece of fabric to the wet paper web contact surface, and at least some of said connecting fibers connecting said first and second pieces of fabric diagonally, in which the openings of said first piece of fabric occupy not more than 50 percent of the area of said surface facing the wet paper web contact surface, is not greater than 0.03 $cm^2$, and in which said layer of three-dimensional knitted fabric is formed by spirally winding a three-dimensional knitted fabric having a width smaller than that of said press felt.

14. A method of manufacturing a press felt for papermaking, said press felt comprising a base body and a fibrous assembly, said press felt having a wet paper web contact surface and a machine contact surface, and including a layer of a three-dimensional knitted fabric comprising first and second pieces of fabric, both having openings, and connecting fibers connecting the first and second pieces of fabric, the three-dimensional knitted fabric being provided within said press felt at a distance from both the wet paper web contact surface and the machine contact surface and the first piece of fabric having a surface facing said wet paper web contact surface and being closer than the second piece of fabric to the wet paper web contact surface, and at least some of said connecting fibers connecting said first and second pieces of fabric diagonally, in which the openings of said first piece of fabric occupy not more than 50 percent of the area of said surface facing the wet paper web contact surface, in which the maximum dimension of said openings, in directions parallel to said surface facing the wet paper web contact surface, is not greater than 0.03 $cm^2$, and in which said layer of three-dimensional knitted fabric is formed by forming a plurality of closed loops of three-dimensional knitted fabric strips in coaxial, side-by-side relationship, each said strip having a width smaller than that of said press felt.

15. A method of manufacturing a press felt for papermaking, said press felt comprising a base body and a fibrous assembly, said press felt having a wet paper web contact surface and a machine contact surface, and including a layer of a three-dimensional knitted fabric comprising first and second pieces of fabric, both having openings, and connecting fibers connecting the first and second pieces of fabric, the three-dimensional knitted fabric being provided within said press felt at a distance from both the wet paper web contact surface and the machine contact surface and the first piece of fabric having a surface facing said wet paper web contact surface and being closer than the second piece of fabric to the wet paper web contact surface, and at least some of said connecting fibers connecting said first and second pieces of fabric diagonally, in which the openings of said first piece of fabric occupy not more than 50 percent of the area of said surface facing the wet paper web contact surface, in which the maximum dimension of said openings, in directions parallel to said surface facing the wet paper web contact surface, is not greater than 0.03 $cm^2$, and in which said layer of three-dimensional knitted fabric is formed by forming a closed loop from a three-dimensional knitted fabric having the same width as that of said press felt.

16. A press felt for papermaking according to claim 1, in which said layer of three-dimensional knitted fabric is a spirally wound strip of three-dimensional knitted fabric, said strip having a width smaller than that of said press felt.

17. A press felt for papermaking according to claim 1, in which said layer of three-dimensional knitted fabric is composed of a plurality of closed loops of three-dimensional knitted fabric strips in coaxial, side-by-side relationship, each said strip having a width smaller than that of said felt.

18. A press felt for papermaking according to claim 1, in which said layer of three-dimensional knitted fabric is in the form of a closed loop of three-dimensional knitted fabric, having the same width as that of said press felt.

19. A press felt for papermaking according to claim 1, in which said connecting fibers consist of both diagonal connecting fibers and connecting fibers disposed in perpendicular relationship to said first and second pieces of fabric, and in which the ratio of the number of perpendicular fibers to the number of diagonal fibers is approximately 1 to 1.

* * * * *

UNITED STATES PATENT AND TRADEMARK OFFICE

CERTIFICATE OF CORRECTION

PATENT NO. : 7,381,665 B2
APPLICATION NO. : 11/032583
DATED : June 3, 2008
INVENTOR(S) : Akira Onikubo et al.

It is certified that error appears in the above-identified patent and that said Letters Patent is hereby corrected as shown below:

Column 12, claim 13, line 14, insert --in which the maximum dimension of said openings, in directions parallel to said surface facing the wet paper web contact surface,-- before "is not greater than 0.03 $cm^2$,"

Column 13, claim 17, line 7, "said felt" should read --said press felt.--

Signed and Sealed this

Nineteenth Day of August, 2008

JON W. DUDAS
*Director of the United States Patent and Trademark Office*